United States Patent [19]

Olsson et al.

[11] 4,359,962

[45] Nov. 23, 1982

[54] LOW-FREQUENCY SOUND GENERATOR

[75] Inventors: Mats A. Olsson, Bromma; Roland Sandström, Skelleftea, both of Sweden

[73] Assignee: Mats Olsson Konsult AB, Bromma, Sweden

[21] Appl. No.: 298,244

[22] Filed: Aug. 31, 1981

Related U.S. Application Data

[63] Continuation of Ser. No. 53,560, Jun. 29, 1981, abandoned.

[30] Foreign Application Priority Data

Jul. 3, 1978 [SE] Sweden ..... 7807473

[51] Int. Cl.[3] ..... G10K 10/00

[52] U.S. Cl. ..... 116/137 R; 134/1; 181/0.5

[58] Field of Search ..... 116/137 R, DIG. 18, 116/DIG. 27; 181/0.5; 134/1

[56] References Cited

U.S. PATENT DOCUMENTS

| | | | |
|---|---|---|---|
| 787,984 | 4/1905 | Hope-Jones | 116/137 R |
| 1,799,387 | 4/1931 | Northey | 116/137 R |
| 1,799,388 | 4/1931 | Northey | 116/137 R |
| 2,434,175 | 1/1948 | Ozols | 116/137 R |
| 2,678,625 | 5/1954 | Hall et al. | 116/137 R |
| 2,693,944 | 11/1954 | Fowle | 116/DIG. 18 |
| 2,792,804 | 5/1957 | Bouyoucos et al. | 116/137 A |
| 3,143,999 | 8/1964 | Bouyoucos | 116/137 A |
| 3,515,093 | 6/1970 | Greene | 116/137 A |
| 4,030,063 | 6/1977 | Wallen | 116/137 A |
| 4,120,699 | 10/1978 | Kennedy, Jr. et al. | 134/1 |

FOREIGN PATENT DOCUMENTS

| | | | |
|---|---|---|---|
| 15102 | 11/1901 | Sweden | 116/137 R |

OTHER PUBLICATIONS

Publ. "Introduction to Study of Mechanical Vibration", by G. W. VanSanten, 4/15/1954, pp. 18, 138, 126, 51-52.

*Primary Examiner*—Daniel M. Yasich
*Attorney, Agent, or Firm*—Finnegan, Henderson, Farabow, Garrett & Dunner

[57] ABSTRACT

A low-frequency sound generator for generating intense sound, which generator includes an open resonator tube. Pressurized gas is supplied to the resonator tube as pulses through a feeder system which includes a valve slide member which controls the pressure of the supplied gas. The gas pulses develop standing sound waves in the resonator tube which provides a varying gas pressure. Means in the resonator tube is operable in response to changes in the gas pressure to provide positive feedback of the sound pressure in the resonator tube to the feeder system at a resonant frequency of the generator.

15 Claims, 7 Drawing Figures

LOW-FREQUENCY SOUND GENERATOR

This is a continuation, of application Ser. No. 53,560, filed June 29, 1981, now abandoned.

The invention relates to a low-frequency sound generator for generating sound of a maximum frequency of about 50 cps.

The low-frequency sound generator according to the invention is of the type comprising an open resonator and a feeder for valve-controlled supply of pressurized gas pulses, usually pressurized air pulses, to the resonator.

It has been found that the results in sooting or cleaning of boilers, furnaces and processing apparatuses by means of sound can be considerably improved by using intense pulses or vibrations of these low frequences, but no suitable device of industrial utility has been available so far.

The invention supplies this demand by a low-frequency sound generator of the type referred to above for generating intense sound of low frequency, which has obtained the characteristics according to claim 1.

Accordingly, the invention is based on the fact that pressurized gas pulses in the resonator are controlled by the frequency of the generated sound. There is thus provided a feed-back system in which the supply of pressurized gas is brought to follow the variations of the sound frequency.

Figure 1:
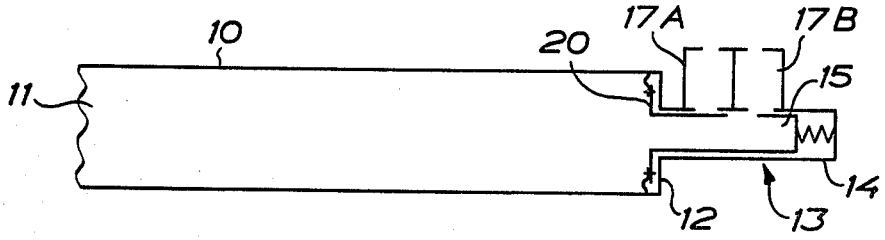
Figure 7:
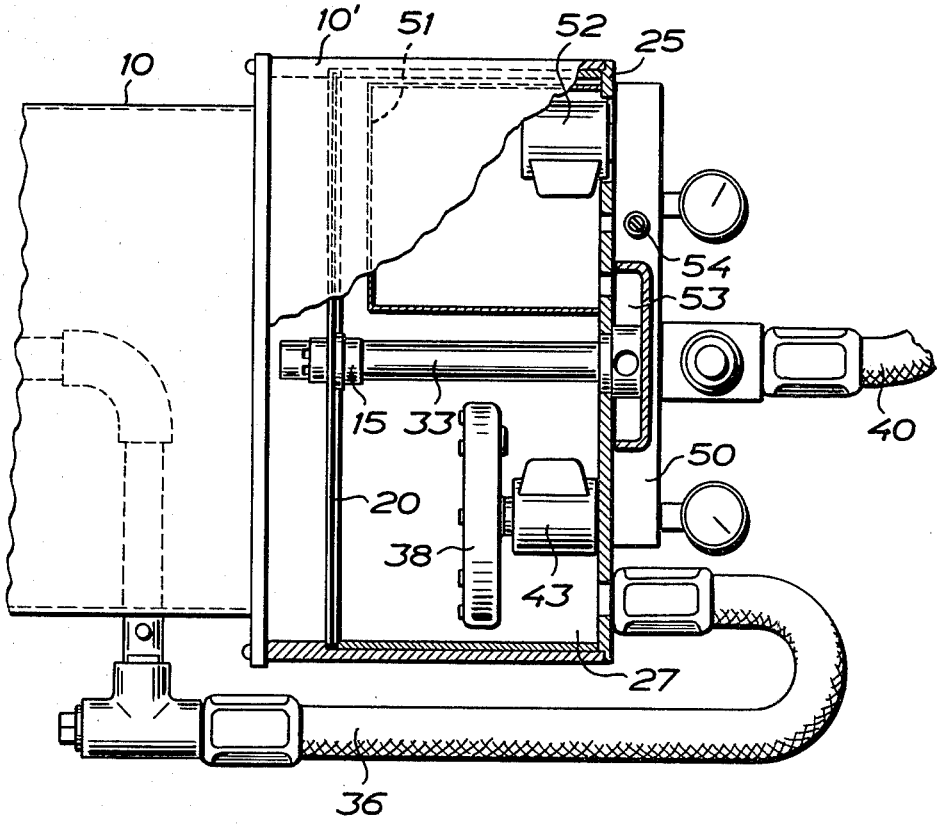
Figure 2:
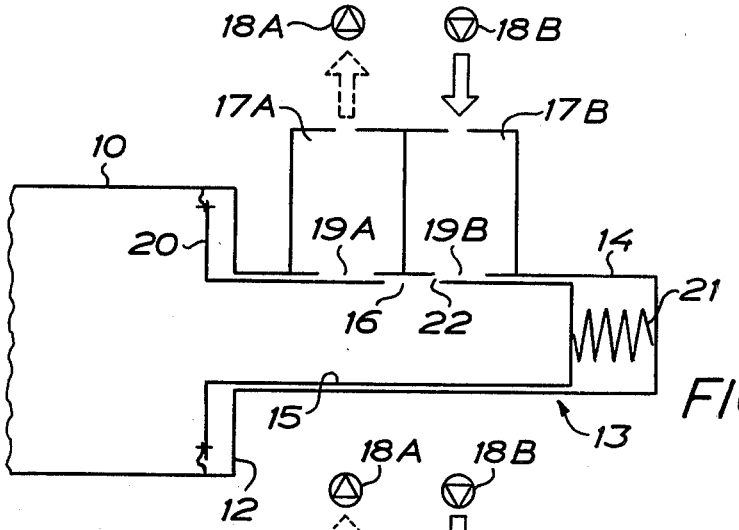
Figure 3:
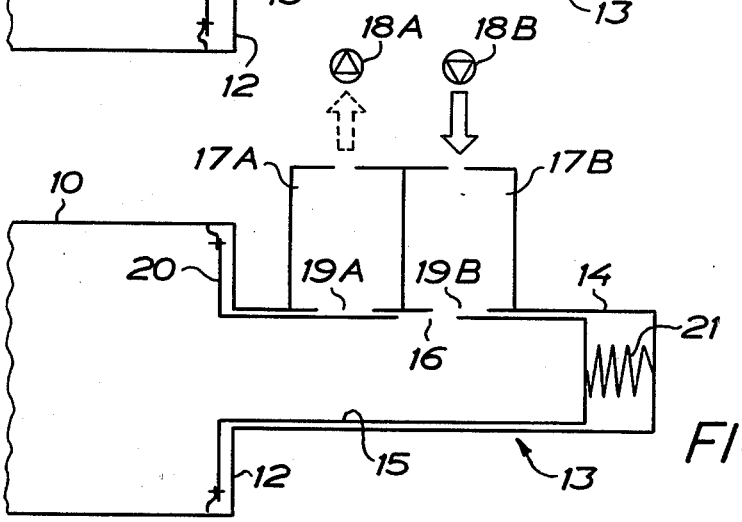
Figure 4:
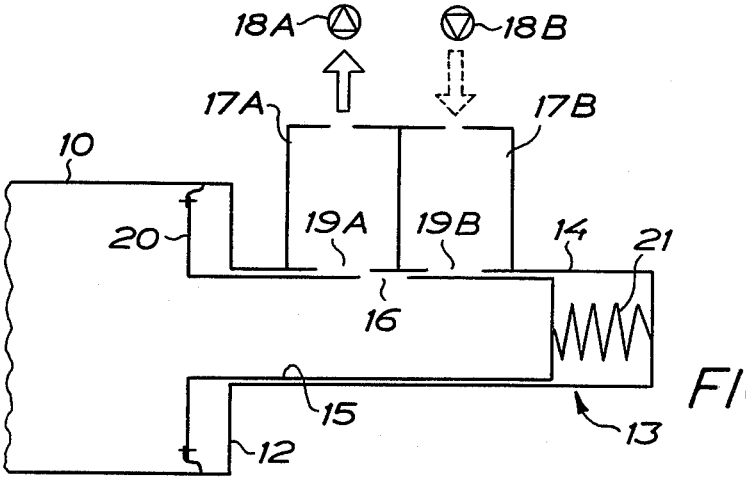
Figure 5:
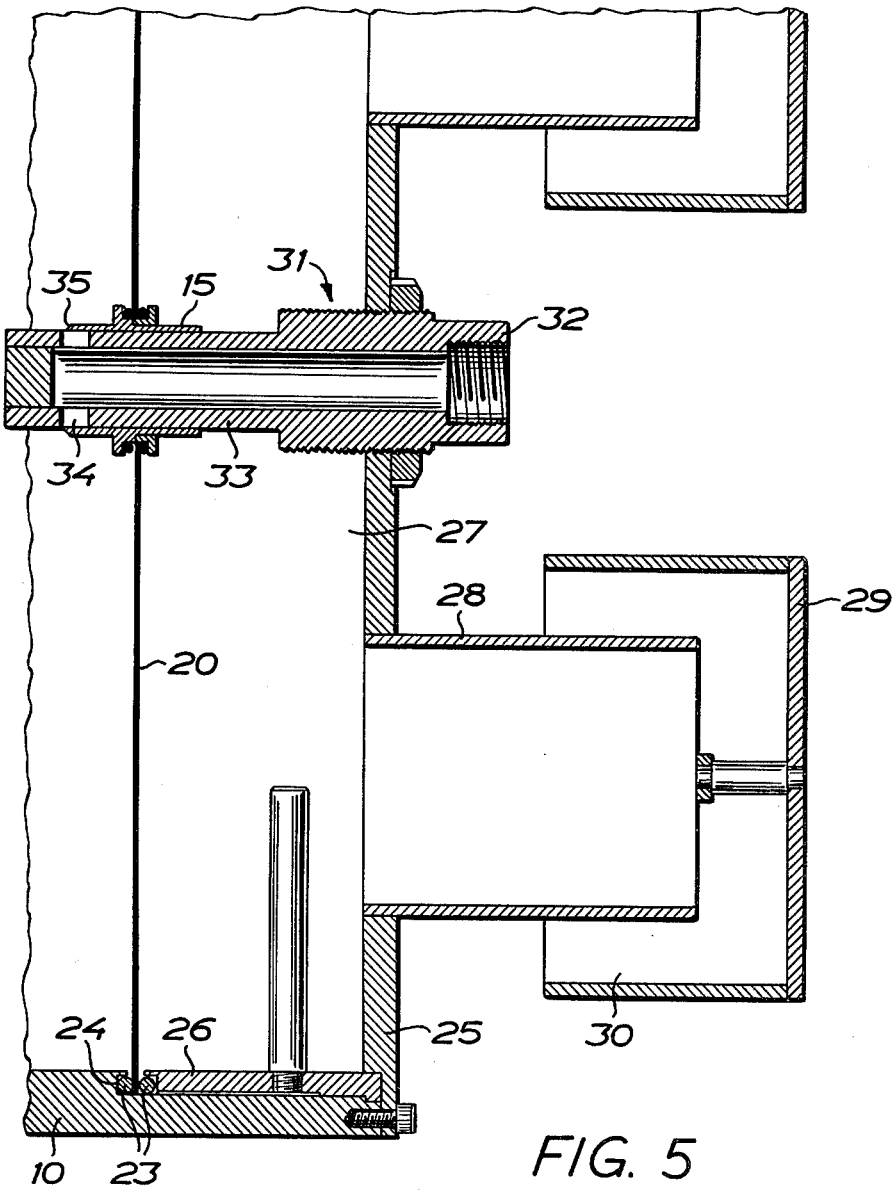
Figure 6:
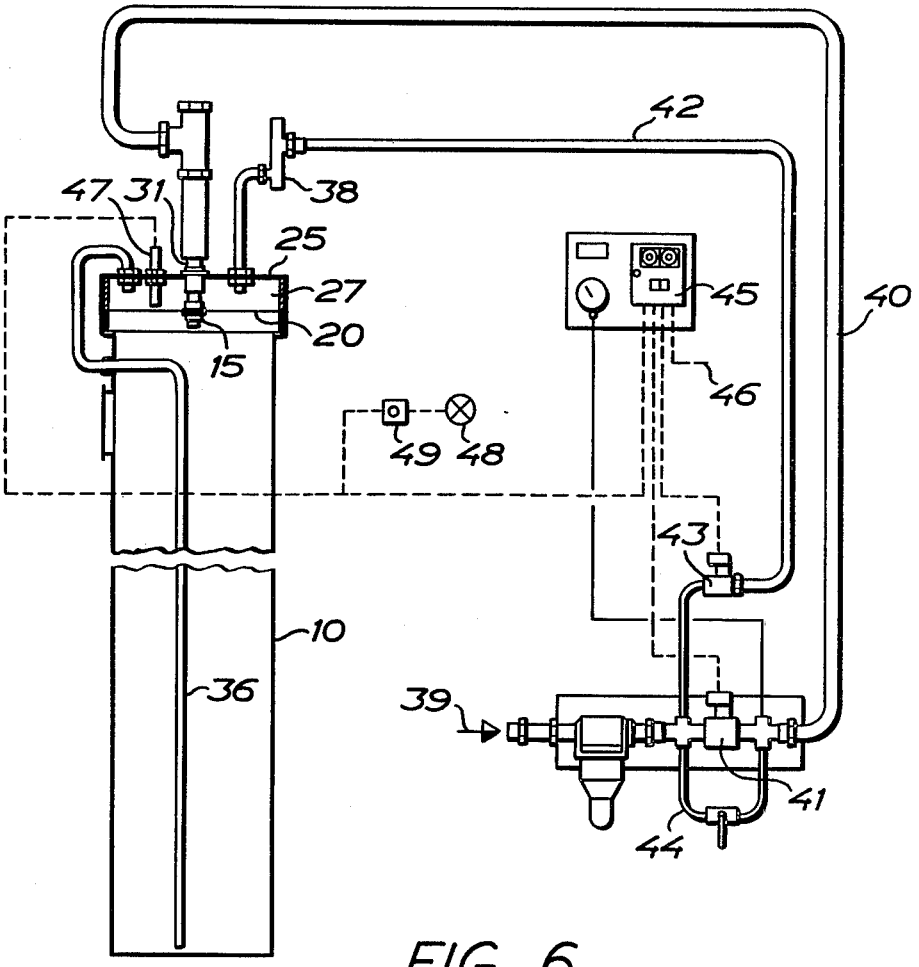
Figure 8:
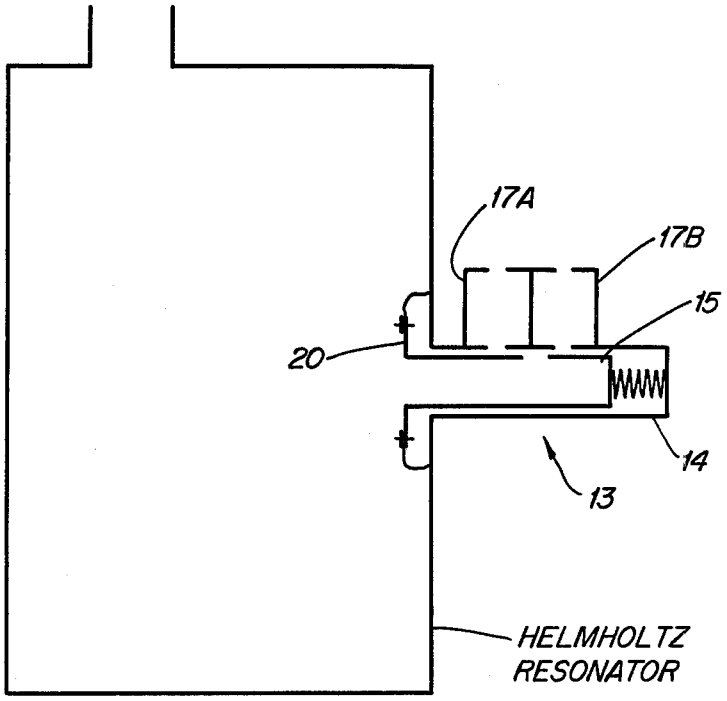

In order to illustrate the invention embodiments thereof will be described in more detail below with reference to the accompanying drawings, in which FIG. 1 is a diagrammatic side view of a sound generator according to the invention, FIG. 2 is an enlarged view of the feeder proper in a rest position, FIGS. 3 and 4 are views similar to FIG. 2 of the feeder in different operational positions, FIG. 5 is an enlarged detail view of a constructive embodiment of the feeder, FIG. 6 is an axial cross-sectional view of a low-frequency sound generator according to the invention of a somewhat modified embodiment, a pressurized gas supply and control system being shown diagrammatically, and FIG. 7 is a fragmentary side view, partly an axial cross-sectional view of a further modified embodiment of the low-frequency sound generator according to the invention, FIG. 8 is a diagrammatic side view showing a Helmholtz resonator incorporating the present invention.

The sound generator shown in FIGS. 1 to 4 comprises a tube 10 of a uniform diameter over the entire length thereof said tube being open at one end, indicated at 11, and closed at the other end, indicated at 12. A tube such as tube 10 having open and closed ends operates as a resonator so that standing sound waves can be generated therein. These standing sound waves having an antinode at the open end and a node at the closed end of the resonator tube must satisfy the condition $$l=\lambda(2n+1)4 \quad (1)$$

where $l$=the length of the resonator tube $\lambda$=the wave length of the standing wave, and $n=0, 1, 2, 3, \ldots$ The sound wave the wave length of which is one fourth of the length of the resonator tube ($l=\lambda/4$, i.e. $n=0$) is designated the fundamental tone the other sound waves being designated the first harmonic, the second harmonic, etc. In the present case it is assumed that the resonator tube 10 has a length which equals one fourth of the frequency to be generated by the sound generator.

The standing sound waves provide a varying air pressure in the resonator tube the largest pressure amplitude arising in the closed end of the resonator tube.

The sound frequency and the wave length are interrelated according to $$f=c/\lambda \quad (2)$$

where $f$=the sound frequency $c$=the propagation rate of the sound wave, and $\lambda$=the wave length.

When a fundamental tone is being generated in a resonator tube having open and closed ends the relationship $$f=c/4l \quad (3)$$

applies according to the above-mentioned relationships (1) and (2).

In air of the temperature 20° C. the propagation rate of the sound wave is 340 m/sec. Applying the above-mentioned relationship (3) e.g. to a resonator tube having a length of 5 m, the frequency of the fundamental tone therein will be $$f=340/4\cdot5$$

a frequency $f=17$ cps being obtained accordingly. Thus, sound could be generated in a resonator tube having a length of 5 m by supplying air pulses of the frequency 17 cps. If the temperature in the resonator tube is changed, also the propagation rate of the sound wave will be changed providing a change in the frequency according to the above-mentioned relationship (3).

In the closed end 12 there is provided a feeder 13 controlling the supply of pressurized gas (operating gas) to the sound generator, and usually pressurized air is supplied although other gases can of course be used such as inert gases.

In the embodiment according to FIGS. 1 to 4 the feeder 13 comprises a stationary part 14 formed as a cylinder joined concentrically to the resonator tube but having a smaller diameter than said tube. A movable part 15 is arranged for axial displacement in the stationary part said movable part being formed as a sleeve-type valve slide having a control opening 16. On the stationary part 14 two compartments 17A and 17B are arranged, the compartment 17A being connected to a suction fan as marked by the symbol at 18A, and the compartment 17B being connected to a pressure fan as indicated by the symbol at 18B (see FIGS. 2–4), so that a pressure above and below the atmospheric pressure, respectively, can be maintained in said compartments. Each compartment has an opening 19A and 19B, respectively, to be connected through this opening with the interior of the slide 15 through the control opening 16 thereof in dependence on the actual axially displaced position of the slide 15.

The slide is connected to a membrane 20 which is secured to the resonator tube in the closed end thereof and is displaceable against the bias of a compression spring 21 in dependence on the pressure in the closed end of the resonator tube, said pressure acting over the membrane 20. In a position of equilibrium shown in FIG. 2, in which the pressure in the closed end of the resonator tube is as large as the surrounding pressure, the slide 15 should be in a position wherein the compartment 17A is disconnected from the resonator tube 10 due to the fact that the communication through the opening 19A and the control opening 16 is interrupted, the compartment 17B, however, communicating with the interior of the slide through the opening 19B and the control opening 16 and thus with the interior of the resonator tube through a narrow opening 22.

Pressurized air (or another gas) accordingly can pass through the narrow opening 22 from the compartment 17B via the slide 15 into the resonator tube 10, and when air is passing through the feeder and the resonator tube low-frequency sound will be generated by turbulence and friction of the air flow.

The sound thus generated acts on the closed end 12 of the resonator tube 10 at a varying pressure and the pressure variations thus produced in the resonator tube provide a reciprocating axial movement of the membrane 20 and accordingly of the slide 15 at a frequency which equals a resonant frequency of the resonator, in this example, the frequency of the fundamental tone said latter frequency being dependent on the length (l) of the resonator tube 10 as explained above. The membrane 20 therefore provides a positive feedback of sound pressure in the resonator tube 10 to the feeder 13. One condition that must be fulfulled if this movement is to be induced in this example is, however, that the movable parts of the feeder 13 have a natural frequency higher than the frequency of the fundamental tone but lower than the frequency of the first harmonic.

When the sound pressure in the closed end of the resonator tube is at maximum (above the atmospheric pressure) the movable slide 15 will be displaced to the right against the bias of the spring 21 to the position shown in FIG. 3 the passage area between the compartment 17B and the resonator tube being increased, which means that the pressure in the closed end of the resonator tube will be increased. When the sound pressure is at minimum (below the atmospheric pressure) the slide 15 is displaced to the left to the position shown in FIG. 4 so that the passage between the resonator tube and the compartment 17B will be closed and communication will be provided between the resonator tube and the compartment 17A, which means that the pressure in the closed end of the resonator tube will be further reduced.

Thus, it will be seen that at the start of the sound generator when the movable part of the feeder (the membrane 20 and the slide 15) is at rest in the position of equilibrium thereof according to FIG. 2 and the fans 18A and 18B have just been started, a faint low-frequency sound will be generated in the resonator tube 10 by the air flow. This sound provides an oscillating movement of the movable part; the sound pressure in the resonator tube will increase to reach, after a certain period, a continuing condition wherein an intense low-frequency sound is generated in the sound generator.

The operation principally will be the same if the compartment 17A is dispensed with. In the constructive embodiment according to FIG. 5 this is the case. The membrane 20 is clamped against O-rings 23 between a shoulder 24 in the rear end of the resonator tube 10 and a bushing 26 secured by means of an end cover 25 mounted by screws. The space 27 behind the membrane 20 is vented to the atmosphere through cylindrical sockets 28 on the end cover 25. These sockets are covered by cylindrical caps 29 each socket and the associated cap forming a labyrinth passage 30 which provides free communication between the space 27 and the surrounding atmosphere dirt being prevented from entering said space.

A pipe 31 is connected to the end cover 25 the outer end 32 of said pipe being adapted to be connected to the fan 18B or other source of pressurized gas while the remaining part of the pipe forms a socket 33 projecting freely into the resonator tube. The slide 15 secured centrally to the membrane 20 is displaceably guided on this socket which is closed at the inner end thereof where the socket forms transverse bores 34 so that the slide controls at the edge 35 thereof the communication between the source of pressurized gas and the interior of the resonator tube 10 through the bores 34 corresponding o the opening 19B in FIGS. 2 to 4. The operation in this case is the same as that described with reference to FIGS. 1 to 4 but there is obtained a resulting gas flow through the resonator tube, which in some cases is of no significance and in other cases can be aimed at. A spring can be provided at the right side of the membrane 20, corresponding to the spring 21, but the slide 15 can also be returned by the inherent spring action of the membrane only.

If the resonator tube 10 of the sound generator is inserted into a space such as a boiler or furnace wherein the pressure is above or below the surrounding atmospheric pressure, a static pressure difference over the membrane 20 will be obtained if the space 27 is connected to the surrounding atmosphere in the manner shown in FIG. 5. As a consequence thereof, the position of equilibrium of the membrane and accordingly also the position of equilibrium of the slide 15 will be changed, and this must be compensated for by a corresponding change of the position of the slide. FIG. 6 discloses an embodiment wherein such compensation is provided. In this case the arrangement for venting the space 27 through the sockets 28 and the passages 30 has been dispensed with and the space 27 communicates through a pipe 36 with the mouth of the resonator tube 10. Accordingly, there will always be the same static pressure at the two sides of the membrane 20. Due to the fact that the pipe 36 opens into the mouth of the resonator tube 10 where the sound pressure has a node the pressure in the space 27 will not be affected by the sound pressure in the resonator tube and therefore the sound generator according to FIG. 6 can be connected to spaces wherein a pressure above or below the atmospheric pressure is maintained without any inconvenience.

Since there is no direct communication between the space 27 and the surrounding atmosphere in the embodiment according to FIG. 6 and said space accordingly can be considered as closed the air body in the space 27 forms a spring behind the membrane 20 said spring action being added to the inherent spring action of the membrane and actuating the natural frequency of the movable system. It is desired to use a thin membrane in the sound generator according to the invention, but the thinner the membrane the lower the spring rate. If the membrane is made too thin, the spring rate may be too low in relation to the mass of the membrane, which provides a too low natural frequency. Moreover, it is difficult to manufacture thin membranes which have the same spring rate in both directions. The air cushion in the embodiment according to FIG. 6 makes possible to use a membrane having a lower spring rate and moreover the air cushion has the same spring properties whether the membrane moves outwards or inwards. Although a thinner membrane per se has different properties in the two directions this will no longer affect the spring rate of the total system to the same extent as when no air cushion is provided, due to the fact that the spring action of the membrane provides a minor part only of the total spring action. E.g. it can be mentioned that a membrane having a thickness of 1.5 mm in a practical embodiment of the sound generator according to FIG. 5 has a spring rate of about 40,000 N/m while the air cushion in the space 27 of the embodiment according to FIG. 6 if said space has a volume of 24 liters will actuate the membrane by a spring action corresponding to a spring rate of the membrane of about 30,000 N/m. If the total spring rate should be about 40,000 N/m the membrane per se thus has to contribute to a minor extent to said spring rate.

FIG. 6 discloses a further refinement in the sound generator according to the invention, viz. a pneumatic pulsator 38 which is connected to the space 27. When the sound generator is used e.g. for sooting boilers, furnaces and processing apparatuses it is the intention that it should be operated intermittently and in that case it may happen that the sleeve-type slide 15 when it has been at rest and is to be operated again, jams on the socket 33 particularly if the sound generator is being used in a corrosive environment so that the faint sound pressure produced by the passage of the pressurized air through the narrow openings uncovered at the transverse bores 34 said openings being of the order 1 mm will not be sufficient to overcome the rest friction of the movable system and to start the membrane movement. Then, the pulsator 38 can be used for starting the sound generator by supplying to the space 27 blows of pressurized air of substantially the same frequency as the fundamental tone of the sound generator said air blows actuating the membrane 20.

FIG. 6 discloses in more detail the equipment associated with the sound generator according to the invention. Pressurized air is supplied from a suitable source of pressurized air at 39 to a conduit 40 via a solenoid valve 41 as well as a conduit 42 via a solenoid valve 43 said conduit 40 extending to the feeder of the sound generator and being connected to the end 32 while the said conduit 42 extends to the pulsator 38. Over the solenoid valve 41 there is provided a choked shunt 44 for a purpose to be described.

A timer 45 is connected to an electric power source by means 46 and the electric connections from this timer are indicated by dash lines. It will be seen that the timer is connected of the two solenoid valves 41 and 43 to control the supply of pressurized air to the sound generator and the pulsator, respectively. As mentioned above, the sound generator usually is operated intermittently and the operating and rest periods are adjusted by means of the timer 45 the valve 41 being opened during the operating period. During the rest period when the valve 41 is closed a minor air flow is supplied to the sound generator through the shunt 44 and this reduced air supply is provided in order to cool the slide 15 and the membrane 20 and also in order to protect the slide and the socket 33 from dust. Moreover, this supply of air maintains a slight movement of the membrane 20 facilitating the start of the sound generator so that the sound generator which is self-starting per se, will operate immediately when the valve 41 is opened without assistance of the pulsator 38 although the sound generator is being used in a corrosive environment where there is a risk of the slide 15 getting stuck or jamming if the membrane 20 is completely immobilized during the rest periods. A probe 47 is located in the space 27 to sense the movement of the membrane 20 and thus to check that the membrane 20 is moving when the sound generator is operated with the valve 41 is opened position. If this probe does not sense a movement of the membrane a signal lamp 48 will be illuminated. Then, the pulsator 38 can be energized by opening the solenoid valve 43 over a switch 49 associated with said lamp so that the necessary assistance for starting the sound generator will be provided.

In the embodiment according to FIG. 7 the conduit 40 is provided for supplying pressurized air to the sound generator proper as well as the pulsator 38 which is located together with the solenoid valve 43 in the space 27 in this embodiment. The conduit 40 is connected to a distributor 50 from which the pressurized air can be supplied to the pulsator 38 via the solenoid valve 43 and also to a surge tank 51 via a solenoid valve 52, the tank as well as the solenoid valve being located in the space 27. From the tank 51 there is provided a connection 53 to the socket 33. When the sound generator is operated the solenoid valve 52 is open and the pressurized air for operating the sound generator thus passes through the tank 51. An equilization of the pulsation of the pressurized air will be obtained thereby so that a smaller dimension of the conduit 40 can be used than if said conduit is connected directly to the socket 33.

Pressurized air can be supplied to the tank 51 from the distributor 50 also via an adjustable choked shunt 54 through a connection between the distributor 50 and the tank 51, said connection being parallel to the connection via the solenoid valve 52. During the rest periods when the solenoid valve 52 is closed the membrane 20 and the slide 15 are kept moving by a choked air flow passing into the tank 51 and then to the socket 33. This arrangement thus replaces the shunt 44 in the embodiment according to FIG. 6.

In FIG. 7 the feeder 10' is mounted as a separate unit to the resonator tube 10 and the same arrangement can be provided in the embodiments according to FIGS. 5 and 6.

In the embodiments described the sleeve-type slide 15 is connected mechanically directly to the membrane 20 but it is also possible to provide the connection between the membrane and the slide by means of an electric, pneumatic or hydraulic transmission between these two elements. Furthermore, the mechanical feeder described herein, which includes a membrane, can be replaced by an electro-mechanical unit, a microphone e.g. being located in the rear end of the resonator tube to sense the pressure variations of the standing wave and a solenoid valve controlling the supply of pressurized air to the resonator tube (or the evacuation of said tube) is controlled directly or indirectly concurrently with the pressure variations of the standing wave, over a band pass filter.

In the embodiments described the slide 15 is returned by the inherent spring action of the membrane 20 only or by this spring action combined with the air spring action in the space 27, but it is also possible to arrange a mechanical spring at the right side of the membrane 20 corresponding to the spring 21 in FIGS. 2 to 4, as mentioned above.

A tube forms a simple and cheap resonator but it can be replaced by other resonators, e.g. a horn or a Helmholtz resonator (see FIG. 8).

We claim:

1. Low-frequency sound generator for generating sound less than 50 cps comprising an open resonator tube (10), a feeder system (13) connected at one end of said resonator tube and having a diameter smaller than that of said resonator tube and including a movable valve slide member (15) operable to vary the pressure of gas pulses supplied to the resonator tube, said resonator tube having a length equal to one-fourth of the frequency generated, said gas pulses being operable to develop standing sound waves in said resonator tube, said sound waves providing a varying gas pressure in said resonator tube, characterized by means (20) in said resonator tube connected to said movable valve slide member operable in response to changes in said pressure to provide positive feedback of the sound pressure in the resonator tube to the feeder system only at a resonant frequency of the resonator tube.

2. Low-frequency sound generator according to claim 1 characterized by a tank (51) in the feeder system for supplying the pressurized gas to the movable valve member (15) through said tank.

3. Low-frequency sound generator according to claim 1 or 2 characterized in that the feeder system comprises valve means (41;52) for supplying a flow of pressurized gas to the resonator (10) alternatively directly or through choked shunt means (44;54).

4. Low-frequency sound generator according to claim 1 characterized in that the valve slide member (15) comprises a sleeve-type slide.

5. Low-frequency sound generator according to claim 4, characterized in that the sleeve-type slide is displaceably guided on a socket (33) which extends into the resonator tube (10), said socket having at least one bore (34) for the supply of pressurized gas and being controlled by the sleeve-type slide.

6. Low-frequency sound generator according to claim 1 characterized in that the resonator tube (10) is open at one end, the feeder system (13) and the feedback means (20) being arranged at the other end of the resonator tube.

7. Low-frequency sound generator according to claim 1 characterized in that the resonator comprises a Helmholtz resonator.

8. Low-frequency sound generator according to claim 1 characterized in that the valve slide member (15) is arranged to maintain, in the equilibrium position of the membrance (20), a narrow opening (22) in the feeder system, the size of said opening being varied for producing sound in the resonator (10) when pressurized gas is supplied therethrough.

9. Low-frequency sound generator according to claim 1 characterized in that a space (27) is defined in the resonator (10) between the membrane (20) and an end wall (25) provided behind the membrane.

10. Low-frequency sound generator according to claim 9 characterized in that said space (27) communicates with the surrounding atmosphere.

11. Low-frequency sound generator according to claim 10 characterized in that the communication between said space and the surrounding atmosphere is provided through one or more external sockets (28) on the rear end wall (25) the outer ends of said sockets being covered by caps (29) which form a labyrinth passage (30) together with the sockets.

12. Low-frequency sound generator according to claim 10 characterized in that said space (27) communicates with the open end of the resonator tube (10) through a conduit (36).

13. Low-frequency sound generator according to claim 9 characterized in that a pulsator (38) is connected to said space (27) for generating blows of pressurized gas in the space at a frequency which is substantially the same as the frequency of the sound generator.

14. Low-frequency sound generator according to claim 9 characterized by a probe (47) for indicating the operational condition of movement or rest of the membrane (20).

15. Low-frequency sound generator according to claim 1 characterized in that the natural frequency of the movable parts of the feeder system (13) is higher than the frequency of the fundamental tone of the resonator (10) but lower than the frequency of the first harmonic.

* * * * *